US012054957B2

(12) United States Patent
Paul

(10) Patent No.: US 12,054,957 B2
(45) Date of Patent: Aug. 6, 2024

(54) SYSTEMS, METHODS, AND APPARATUS FOR CONCRETE STAIR FORMS

(71) Applicant: Brody Paul, White Rock (CA)

(72) Inventor: Brody Paul, White Rock (CA)

( * ) Notice: Subject to any disclaimer, the term of this patent is extended or adjusted under 35 U.S.C. 154(b) by 371 days.

(21) Appl. No.: 17/528,194

(22) Filed: Nov. 17, 2021

(65) Prior Publication Data

US 2022/0220754 A1 Jul. 14, 2022

Related U.S. Application Data

(60) Provisional application No. 63/115,065, filed on Nov. 18, 2020.

(51) Int. Cl.
*E04G 13/06* (2006.01)

(52) U.S. Cl.
CPC ..... *E04G 13/062* (2013.01)

(58) Field of Classification Search
CPC ..... E04G 13/062
See application file for complete search history.

(56) References Cited

U.S. PATENT DOCUMENTS 4,916,796 A * 4/1990 Baumgartner ..... E04G 13/06 29/407.05
8,865,034 B2 * 10/2014 Poulin ..... E04G 13/06 425/65

* cited by examiner

*Primary Examiner* — James Sanders

(57) ABSTRACT

Apparatus, systems and methods for holding a riser of a step form in position when pouring concrete to make a stairway are provided. The apparatus is a bracket that may include a riser support for coupling with the riser. The bracket also includes a top support. A first end of the top support may be connected to the riser support for providing support to the riser support. The bracket may additionally include a back support for providing support to the riser support. The back support may be coupled to both the riser support and the top support such that an area enclosed by the riser support, the back support and the top support is a triangle. At least two of the riser support, the back support and the top support may include fastening plates for coupling with an external support.

11 Claims, 6 Drawing Sheets

SYSTEMS, METHODS, AND APPARATUS FOR CONCRETE STAIR FORMS

TECHNICAL FIELD

The present disclosure relates to concrete stair forms, and in particular, brackets for forming concrete stairs.

BACKGROUND

Concrete steps are ubiquitous in their use around the world, whether it be in residential properties, commercial properties or in public places. Concrete steps provide easy pedestrian access between different elevations. They are relatively cheap and can last for decades.

The construction of concrete steps and stairs generally involves the use of forms to shape the stairs. A stringer may be cut out to hold planks in place to shape the risers. Stringers may be made for a specific staircase by cutting steps into a wooden board. The stringer holds the planks for the risers in place against the pressure of the concrete that the forms are shaping. Depending on the width of the staircase, stringers may be used at cither side of the staircase and in central portions of the staircase.

There exists a continuing desire to advance and improve technology related to forms for concrete staircases.

SUMMARY

According to one aspect, there is provided a bracket for holding a riser of a step form in position when pouring concrete to make a stairway. The bracket may include a riser support for coupling with the riser. The riser support includes a surface for bearing against the riser. The bracket also includes a top support. A first end of the top support may be connected to the riser support for providing support to the riser support. The bracket may additionally include a back support for providing lateral support to the riser support. The back support may be coupled to both the riser support and the top support such that an area enclosed by the riser support, the back support and the top support is a triangle. At least two of the riser support, the back support and the top support may include fastening plates for coupling with a support extending from a top of the stairway to a bottom of the stairway. Each of the fastening plates may be parallel to a plane defined by the triangle and positioned to contact the support.

BRIEF DESCRIPTION OF THIS DRAWINGS

Figure 1A:
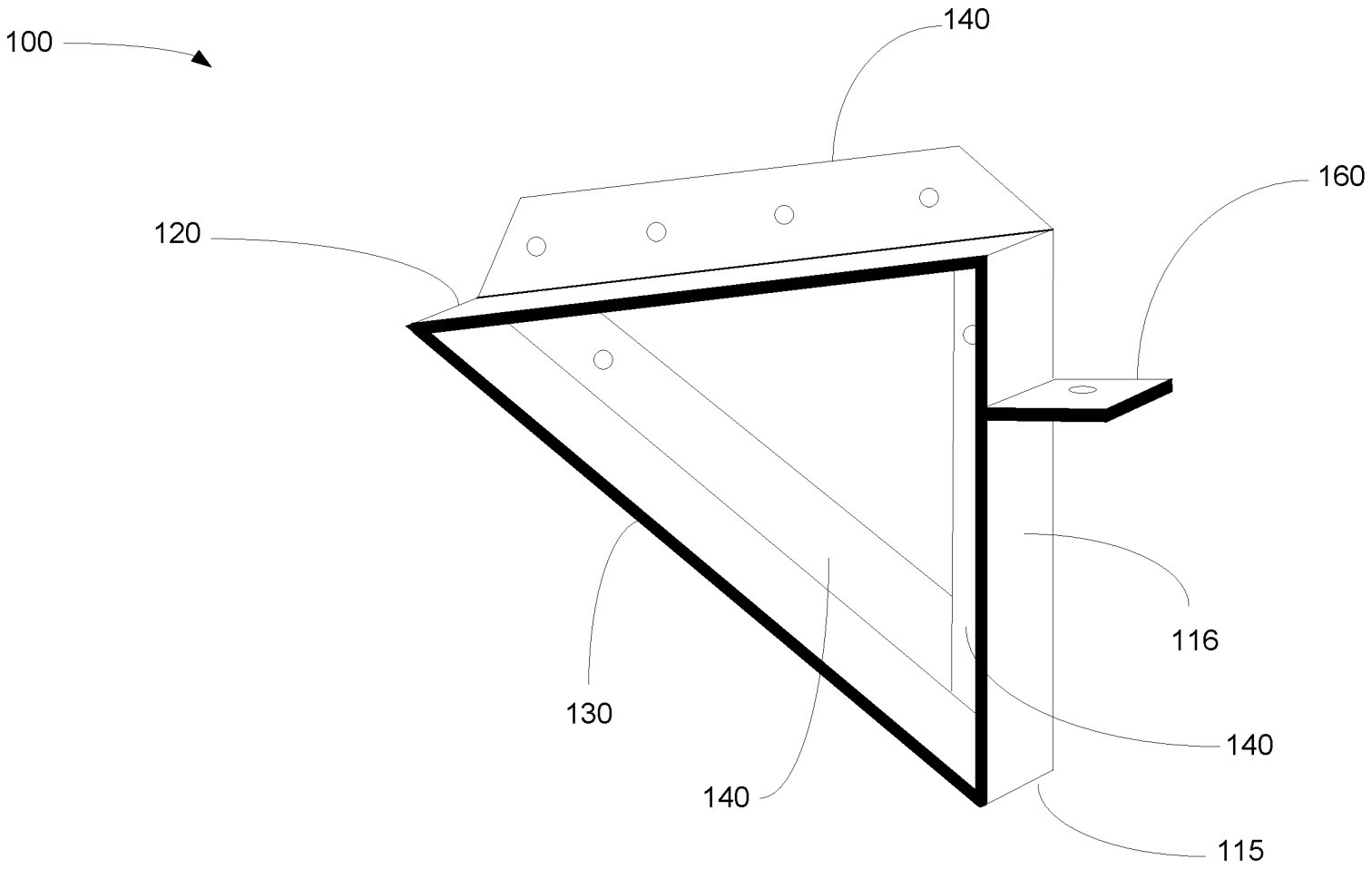
Figure 1B:
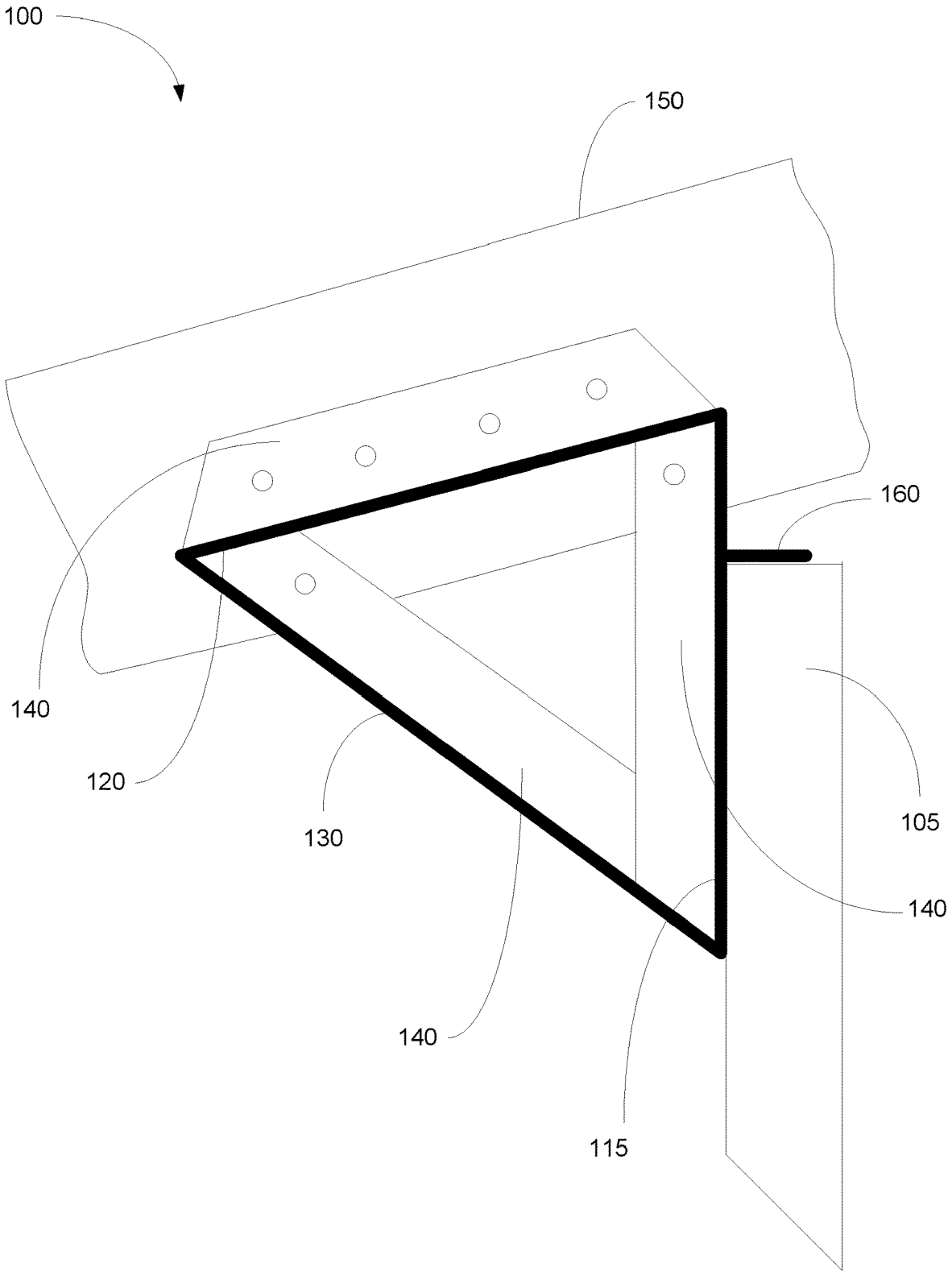

In the accompanying drawings, which illustrate one or more example embodiments,

FIG. 1*a* is a perspective view of a bracket, according to one embodiment;

FIG. 1*b* is a front view of the bracket of FIG. 1*a;*

Figure 2A:
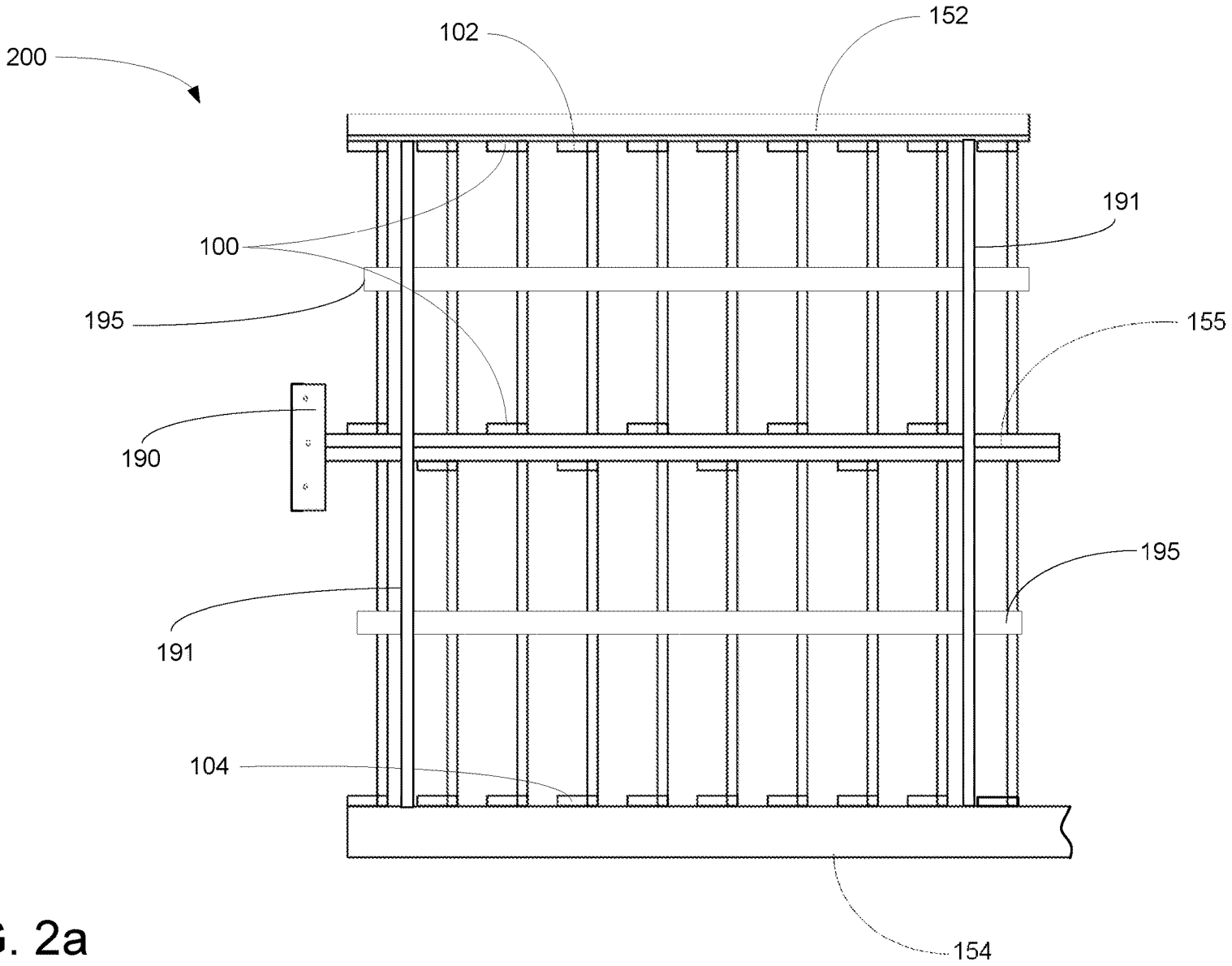
Figure 2B:
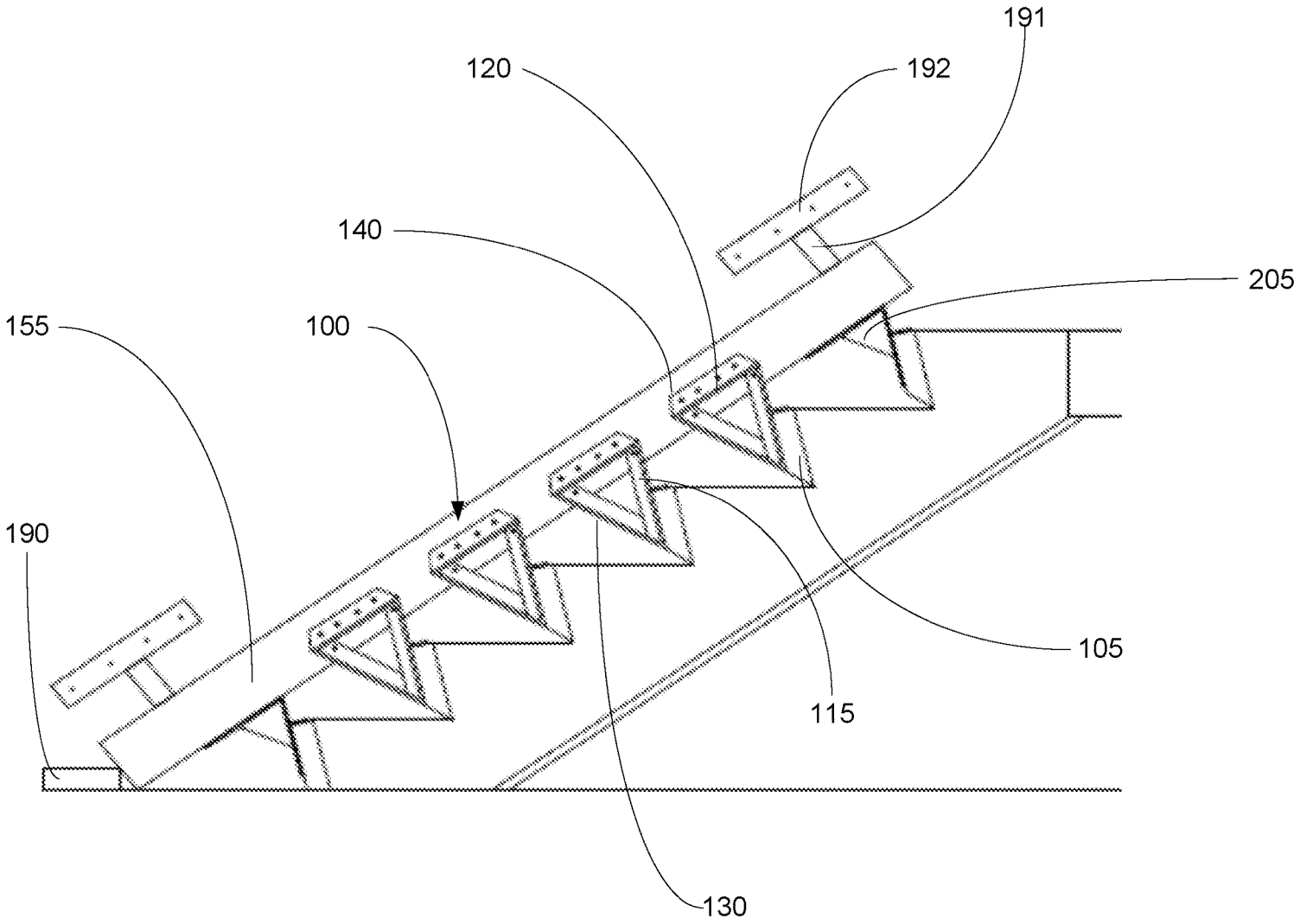
Figure 3:
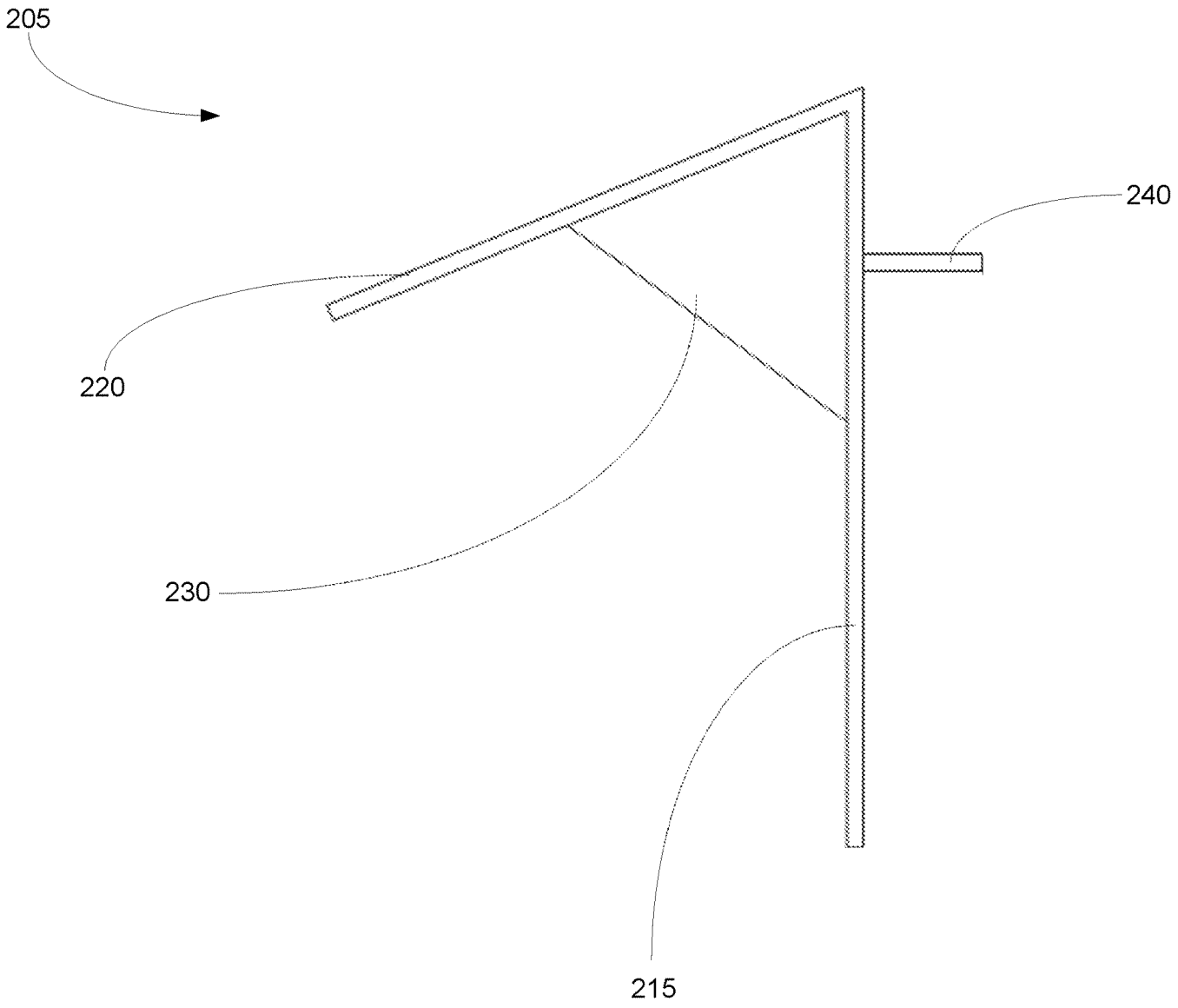
Figure 4:
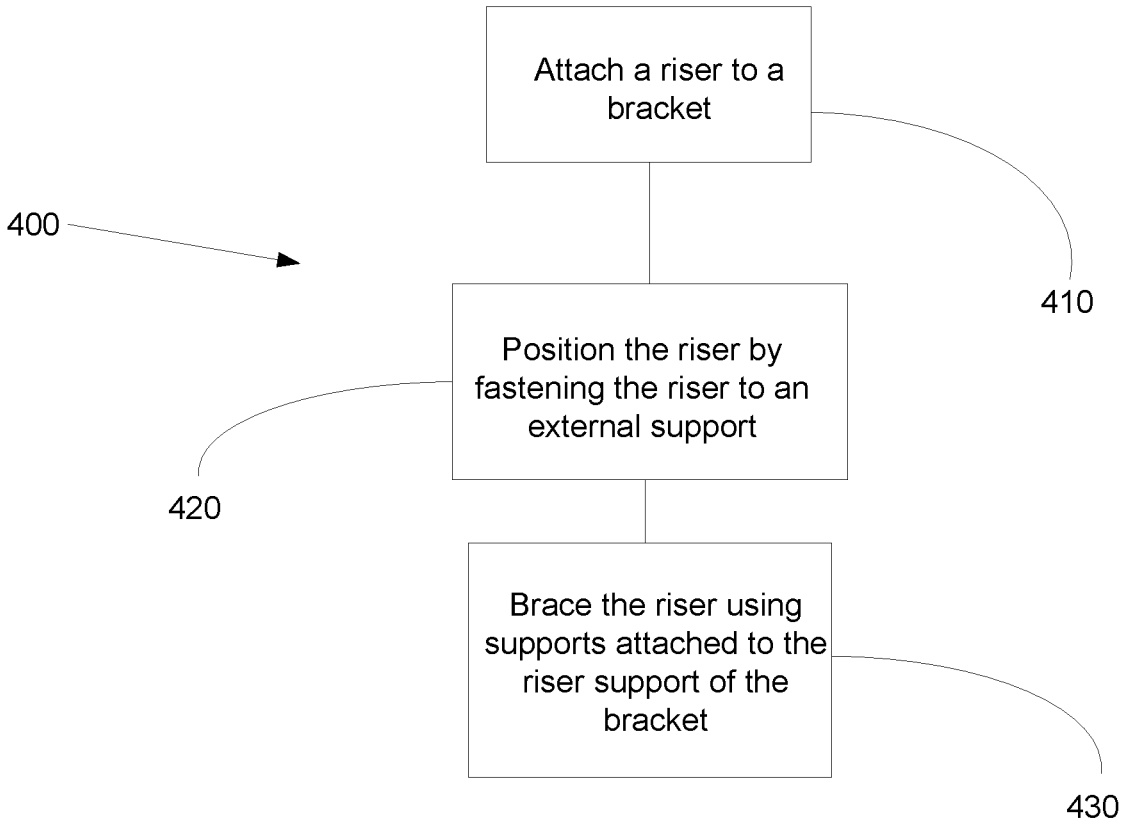

FIG. 2*a* is a perspective view of a bracket system according to one embodiment;

FIG. 2*b* is a side view of a bracket system according to one embodiment;

FIG. 3 is a perspective view of a lift bracket according to one embodiment; and FIG. 4 shows a method for bracing a riser for a stair form using a bracket according to one embodiment.

DETAILED DESCRIPTION

Directional terms such as "top", "bottom", "upper", "lower", "left", "right", and "vertical" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", "coupling", and "couplable" as used in this description are intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections. The term "couplable", as used in the present disclosure, means that a first device is capable of being coupled to the second device. A first device that is communicatively couplable to a second device has the ability to communicatively couple with the second device but may not always be communicatively coupled.

Concrete staircases are generally constructed by pouring concrete into a sloped area shaped by forms arranged in a stepped manner. Wooden boards with one face having a width equal to a desired riser height are placed horizontally across the width of the staircase. The face that has a width equal to the riser height is used to form a step having the riser height. The next board is spaced laterally and vertically from the first board to form the next step. Stringers are used to hold the wooden boards in place. Stringers are generally made of wooden boards, such as 2"×6" or 2"×8" boards. A stair pattern with the desired dimensions is cut into the board. Stringers are then nailed or screwed to the boards forming the risers to hold them in place. Stringers may be placed at the ends and, depending on the width of the staircase, in central portions of the staircase.

Stringers are generally custom made for each particular staircase. Work crews often cut them out on site. Cutting and installing a stringer takes time and skill. Multiple workers may be needed to install stringers. After a project is complete, stringers are often discarded.

Due to the cutting out parts of the board to make a stringer, the stringer may lack the strength of the board it is made from. Additionally, the sharp corners cut into the stringer may concentrate stress at those points, increasing the chance of failure. The pressure of the concrete pushing against the forms may be quite high, leading to high stresses on the stringer. Additionally, workers may at times step on top of stringers, creating additional stresses on stringers. Knots and other non-uniformities in the wood of the stringer may also, in some cases, increase the chance of failure of the stringer.

Attempts have been made to replace or complement stringers with metallic bracket systems to address some of the possible shortcomings of stringers. For example, in one existing system, a plate type brace is secured to the riser form on one end and at the other end to a wooden rail that runs at a right angle to the riser form. The brace is twisted in the middle so that the first and second ends are plates at right angles to each other. This brace system may reduce the workload of a crew by lessening the need to cut and install a stringer. However, the brace may have a weak point where the two plates meet with no additional support to brace the lower plate against the riser form.

As another example, in U.S. Ser. No. 12/870,310, an apparatus for forming steps is presented. This apparatus uses specialized fasteners to hold the various parts together when the system is fully assembled. Several rails may be used to hold the brackets against the riser forms. Having long rails and specialized fasteners adds to the complexity of the system. Additionally, work crews will need special storage for the long rails and fasteners in between jobs.

The present disclosure provides triangular shaped brackets that may be attached to a riser form and to either side walls or a rail, such as a 2×6 wooden board, to hold the form in place. Fasteners, such as nails or screws, which are readily available at most jobsites, may be used to attach the bracket to the form and the rail or side walls. The triangular shape of the bracket provides strength while at the same time, may allow sufficient clearance for workers to work on the concrete at the top surface of the tread portion of each step. Brackets may be attached to each riser form at either end across the stairway as well, in some cases, in central portions of the stairway. Installation may be quick, with workers hammering or screwing individual brackets into place.

Any mistakes may also be quickly corrected by replacing a bracket. With stringers, the entire stringer may be removed and reinstalled to correct a mistake. In some cases, a new stringer may need to be made and placed into position. Additionally, each bracket may be used for a range of riser heights and tread lengths.

Storage and replacement of brackets may also be quite simple. Each bracket may be relatively small in size, allowing work crews to store them in relatively compact spaces. Additionally, replacing lost or damaged brackets may be relatively inexpensive as compared to replacing rail systems or creating new stringers for each job. This may be especially advantageous as equipment at construction sites may go through rough treatment.

Referring to FIGS. 1*a*, 1*b*, 2*a* and 2*b*, in accordance with some embodiments, a bracket 100 for holding a riser 105 of a form for a step in position when pouring concrete to make a stairway 110 is provided. The bracket 100 may include a riser support 115 for coupling with the riser 105. The riser support 115 may include a surface 116 for bearing against the riser 105.

The riser support 115 may be of any suitable shape. In some embodiments, the riser support 115 may be a flat plate with a suitable width for bracing the riser 105. For example, in certain embodiments, the riser support 115 may be of a width almost equal to the width of a standard riser, which may be about 1.5". In some embodiments, the width of a flat plate riser (support 115 may be about 1" to 2".

In certain embodiments, the riser support 115 may be a bar. In certain embodiments, the riser support 115 may be a rod.

Standard riser lengths (the height of a step) may vary between about 6.5" and 8". In some embodiments, the bracket 100 may be designed specifically for a particular riser length, such as, for example and without limitation, 6.5". In certain embodiments, the bracket 100 may be used for any standard riser size, with the riser support 115 having a length suitable for a range of riser 105 heights.

The riser support 115 may have any suitable length. In some embodiments, the riser support 115 may have a length sufficiently long to cover a riser 105 completely. A portion of the riser support 115 may, in some embodiments, extend above the riser 105 for coupling with other supports, such as the support beam 150. In certain embodiments, the riser support 115 may not cover the entire length of the riser 105. For example, a lower portion of the riser support 115 may extend to slightly above a bottom of the riser 105. Without limitation, the lower portion of the riser support 115 may extend to about 0.5" to 4" above the bottom of the riser 105. For example and without limitation, in some embodiments, about a 4.5" length of the riser support 115 may be in contact with the riser 105 for bracing the riser 105. The remaining portion of the riser support 115 may extend above the riser 105.

In some embodiments, the bracket 100 may include a positioning tab 160 coupled to the riser support 115. The positioning tab 160 may extend out from the surface 116 of the riser support 115 and may be positioned to bear against a top surface 106 of the riser 105, thereby positioning the bracket 100 relative to the riser 105. In some embodiments, the positioning tab 160 may be fastenable to the top surface 106 of the riser 105. For example, and without limitation, the positioning tab 160 may include one or more holes passing through the positioning tab 160 for allowing the positioning tab to be screwed or nailed to the top surface 106 of the riser 105. Each hole may be of any suitable size for receiving a suitably sized screw or nail to fasten the bracket 100 to the riser 105. In addition to holding up the riser 105, fastening the bracket 100 to the riser 105 may be advantageous by reducing the possibility of the bracket 100 slipping and changing position relative to the riser 105.

The positioning tab 160 may extend out from the surface 116 of the riser support 115 at any suitable angle. For example and without limitation, in some embodiments, the positioning tab 160 may extend out from the front surface 116 of the riser support 115 at an angle of about 90 degrees. In certain embodiments, the positioning tab 160 may extend out from the front surface 116 of the riser support 115 at angles of, without limitation, between about 80 degrees to 100 degrees.

The positioning tab 160 may be of any suitable dimensions. For example, in some embodiments, the positioning tab 160 may be as wide as the riser support 115. In some embodiments, the positioning tab 160 may be wider than the riser support 115 and in certain embodiments, the width of the positioning tab 160 may be less than the width of the riser support 115. For example, and without limitation, the positioning tab may have a width of between about 1" to 1.5".

The positioning tab 160 may have any suitable length to hold the bracket 100 in position against the riser 105. In some embodiments, the positioning tab 160 may be, without limitation, about 0.75" to 1.5" long.

The positioning tab 160 may be attached to the riser support 115 using any suitable coupling. For example, and without limitation, the positioning tab 160 may be welded, bolted, glued, or screwed to the riser support 115. In some embodiments, the positioning tab 160 may be formed integrally with the riser support 115.

In addition to providing a fastening portion for fastening the bracket 100 to the riser 105, the positioning tab 160 may allow relatively simple positioning of the bracket 100 relative to the riser 105. A user may position the bracket 100 without making any measurements. Having the positioning tab may allow for a sufficient portion of the bracket 100 to be above the riser 105 and in position for fastening the bracket 100 to support walls or support beams. The bracket 100 may then be used with rises of different heights while maintaining a consistent portion of the bracket 100 above the riser 105 for attachment to supports.

In some embodiments, the positioning tab 160 may be positioned to position the bracket 100 such that the riser support 115 does not extend closer than about one inch of a tread immediately below the riser support 115.

In some embodiments, the riser support 115 may include one or more fastening tabs extending from a side of the riser support 115 and in the same plane as the front surface 116 of the riser support 115 for use in fastening the bracket 100 to the riser 105. Each fastening tab may include one or more holes passing through the fastening tab for allowing the positioning tab to be screwed or nailed to a front surface of the riser 105. Each hole may be of any suitable size for receiving a suitably sized screw or nail to fasten the bracket 100 to the riser 105.

In some embodiments, the bracket 100 may include a top support 120. A first end 121 of the top support 120 may be coupled to the riser support 115, for providing support to the riser support 115. Additionally, the bracket 100 may also include aback support 130 for providing lateral support to the riser support 115. The back support 130 may be coupled to both the riser support 115 and the top support 120 such that an area enclosed by the riser support 115, the back support 130 and the top support 120 is a triangle.

Referring again to FIGS. 1*a*, 1*b*, 2*a* and 2*b*, in some embodiments, at least two of the riser support 115, the back support 130 and the top support 120 may include fastening plates 140 for coupling with a support 150 extending from a top of the stairway to a bottom of the stairway. Each of the fastening plates 140 may be parallel to a plane defined by the triangle and may be positioned to contact the support 150.

In some embodiments, all three of the top support 120, back support 130 and riser support 115 may include a fastening plate 140.

In some embodiments, a fastening plate 140 of the top support 120 may extend parallel to the plane defined by the triangle and may be positioned such that it does not extend into the triangle. The fastening plate 140 may be at about a 90 degree angle to the top support 120. The fastening plate 140 may be fastenable to the support 150 above the top support 120.

In some embodiments, the fastening plate 140 of the top support 120 may be parallel to the plane of the triangle and may extend into the triangle.

In certain embodiments, the fastening plates 140 of the riser support 115 or the back support 130 may extend parallel to the plane defined by the triangle and may extend into the triangle.

Having a fastening plate 140 coupled to the top support 120 extending away from the triangle and fastening plates 140 coupled to each of the back support 130 and the riser support 115 extending into the triangle may be advantageous by spreading out the attachment points of the bracket 100 to the support, thereby increasing the torque required to twist the bracket 100.

The fastening plates 140 may have any suitable size and shape. For example, in some embodiments, each fastening plate 140 may be as long as the part of the bracket 100 that the fastening plate 140 extends from. For example, a fastening plate 140 of the top plate 120 may have a length about equal to the length of the top plate 120. In certain embodiments, one or more of the fastening plates 140 may be shorter than the support portion of the bracket 100 that they are attached to and in some embodiments, one or more of the fastening plates 140 may be longer than the support portions of the bracket 100 that they are attached to.

In some embodiments, the fastening plates 140 may comprise multiple tabs extending from each support of the bracket 100. For example, the top bracket 120 may have multiple tabs extending from it, each fastenable to the external support 150.

Each fastening plates 140 may extend any suitable distance away from the support portion of the bracket that the fastening plate 140 is attached to. For example, a fastening plate 140 of the top support 120 may extend about 1" to 2" from the top support 120. In certain embodiments, the fastening plate 140 of the top support 120 may extend about 1.5" from the top support 120.

Each of the fastening plates 140 may be coupled to the bracket using any suitable coupling. For example, in some embodiments, the fastening plates 140 may be welded to their respective support arms of the bracket 100. The fastening plates 140 may also be, in some embodiments and without limitation, glued or bolted to the bracket 100 or formed integrally with the bracket 100. In certain embodiments, one or more fastening plates 140 may be hingedly coupled to the bracket 100. The fastening plates 140 may be foldable for storage against the portion of the bracket 100 that they extend from.

Each fastening plate 140 may include one or more holes passing through the fastening plate 140 for allowing each fastening plate to be screwed or nailed to the support 150. Each hole may be of any suitable size for receiving a suitably sized screw or nail to fasten the bracket 100 to the support 150.

In addition to being used to fasten the bracket 100 to a support 150, the fastening plates 140 may also act as support webs between different support arms of the bracket 100 to provide additional strength to the bracket 100. Additional support webs or blocks may be used as additional strengthening supports for the bracket 100.

The support 150 may be, for example, a side wall of the stairway. In certain embodiments, the support 150 may be a support beam, such as a 2×6 or a couple of 2×6s nailed or screwed together, that may extend from the top of the stairway to the bottom of the stairway.

Referring again to the top support 120, in some embodiments, the top support 120 may be coupled to a top end of the riser support 115 and the back support 130 may be coupled to a bottom end of the riser support 115. In certain embodiments, either or both of the top support 120 and the back support 130 may be coupled to the riser support 115 at positions offset from the ends of the riser support 115.

The top support 120 may provide support to the riser support 115 that includes both lateral and vertical components. The support provided by the top support 120 may brace the top portion of the riser support 115 against pressure from the concrete behind the riser 105. Similarly, the back support 130 may provide support to the riser support 115 that includes both lateral and vertical components. The support provided by the back support 130 may brace the bottom portion of the riser support 115 against pressure from the concrete behind the riser 105.

An end of the top support 120 distal to the end connected to the riser support 115 may be connected to or connectable to an end of the back support 130 distal to the end of the back support 130 connected to the riser support 115 such that the top support 120, the back support 130 and the riser support 115 form a triangle. A triangle shape may provide sufficient strength and stability to the bracket 105 to reduce the possibility of failure of the riser support 115.

Each of the top support 120 and back support 130 may have any suitable dimensions. For example, in some embodiments, each of tbc top support 120 and back support 130 may have a width about equal to the width of the riser support 115. In certain embodiments, the width of each of the top support 120 and back support 130 may have a width greater than or less than the width of the riser support 115.

The thickness of each of the support arms of the bracket 100 may depend on the material the bracket 100 is constructed of. Any suitable material may be used for the bracket 100 or the various parts of the bracket 100. For example, and without limitation, metals such as steel, polymer materials including plastics, composites such as fiber glass or carbon fiber materials, or wood may be used. The use of metallic materials like steel may result in a smaller thickness of the parts of the bracket 100 than, for example, the use of plastic materials. In certain embodiments, steel plates with a thickness of between about, for example, 1/16" to 1/8" may be used.

The length of each of the top support 120 and the back support 130 may be of any suitable value. In some embodiments, the length of each of the top support 120 and the back support 130 may be dependent on each other. For example, if the back support 130 is shortened, the angle between the back support 130 and the riser support 115 will be reduced and the top support 120 may be shortened due to intersection with the back support 130. In some embodiments, the top support 120 may extend beyond its point of intersection with the back support 130.

In some embodiments, having a larger triangle between the support arms of the bracket 100 may increase the bracing support for the riser 105. Increasing the angle of intersection between the riser support 115 and the top support 120 and the angle of intersection between the back support 130 and the riser support 115 may increase the lateral component of the support provided by each of the top support 120 and the back support 130. Each of the top support 120 and the back support 130 would be longer if the angles were increased. Increasing the length of each of the top support 120 and the back support 130 may increase the amount of fastening points on the fastening plates 140 as well as the distance between the fastening plates 140, thereby possibly increasing torque resistance.

In some embodiments, the size of the each of the back support 130 and the top support 120 may be kept within certain size parameters to keep the overall size of the bracket 100 from becoming cumbersome. Additionally, increasing the size of the bracket may, in some embodiments, require the use of larger support surfaces for the support 150. For a stairway, each bracket 100 on each step may be fastened to a support 150, such as a support beam. The size of each part of the bracket 100 may be selected such that the fastening plates 140 will maintain contact with the support beam 150 for each step, assuming standard riser and tread sizes.

In certain embodiments, the back support 130 may extend from the riser support 115 at an angle sufficiently small such that there is sufficient clearance between the back support 130 and a tread of a step immediately below the back support 130 to allow the use of surfacing tools on the tread. Large angles between the back support 130 and the riser support 115 may result in low clearance between the back support 130 and the tread immediately below the back support 130, making working on the concrete of the tread difficult.

In some embodiments, the back support 130 may extend from the riser support 115 at an angle smaller than about sixty degrees. In certain embodiments, an angle between the back support 130 and the riser support 115 may be between about 50 degrees and 60 degrees. In some embodiments, the angle between the back support 130 and the riser support 115 may be about 55 degrees. The length of the back support 130 may be between about 8" to 10". In some embodiments, the length of the back support 130 may be about 8¾".

An angle of about 55 degrees between the back support 130 and the riser support 115 may provide sufficient clearance for the tread and sufficient strength for the bracket 100.

An angle between the top support 120 and the riser support 115 may, in some embodiments, be between about, for example, 65 to 75 degrees. In certain embodiments the length of the riser support 115 may be about 8", the length of the top support 120 may be about 8" and the angle between the top support 120 and the riser support 115 may be about 70 degrees, with the remaining two angles of the triangle being about 55 degrees each.

The top support 120 may be coupled to each of the back support 130 and the riser support 115 and the back support 130 may be coupled to the riser support 115 using any suitable coupling. For example, in some embodiments, the coupling may include welds. In certain embodiments, bolting systems may be used to couple the support arms of the bracket 100. Adhesives may also be used in some embodiments.

In certain embodiments, two of the couplings between the support arms of the bracket 100 may include hinged couplings, allowing the support arms to be folded flat for storage. Overlapping extensions at the third point of the triangle may be used to lock bracket into an open position for use.

Referring to FIG. 2*a* and FIG. 2*b*, as well as FIG. 1*a*, an embodiment of a bracket system 200 for constructing forms for a stairway is shown. The bracket system 200 may include at least one pair of brackets 100 for holding a riser 105 of the stairway form in position. Each bracket 100 may include a riser support 115 for coupling with the riser 105. The riser support 115 may include a surface 116 for bearing against the riser 105. The bracket 100 may also include a top support 120. A first end of the top support 120 may be coupled to the riser support 115, for providing support to the riser support 115.

In some embodiments, the bracket 100 may include a back support 130 for providing support to the riser support 115. The back support 130 may be coupled to both the riser support 115 and the top support 120 such that an area enclosed by the riser support 115, the back support 130 and the top support 120 is a triangle.

In certain embodiments, at least two of the riser support 115, the back support 130 and the top support 120 include fastening plates 140 for coupling with one of a first support 152 and a second support 154. Each of the first support 152 and the second support 154 may extend from a top of the stairway to a bottom of the stairway. Each of the fastening plates 140 may be parallel to a plane defined by the triangle. Additionally, in some embodiments, the fastening plates 140 on a first bracket 101 of the pair of brackets 100 may be positioned to contact the first support 152, with the first support 152 located on a first side of the pair of brackets 100. The fastening plates 140 on a second bracket 104 of the pair of brackets 100 may be positioned to contact the second support 154, with the second support 154 being located on a second side of the pair of brackets 100. The riser 105 may extend between the two supports 152, 154 and may be coupled at one end to the first support 152 by the first bracket 102 and at the other end to the second support 154 by the second bracket 104.

For some staircases, a support beam 155, comprising, for example, a 2×6 or a pair of 2×6s layered together, may be placed along a central portion of the staircase, extending from the bottom of the staircase to the top. Risers 105 may be coupled to the support beam using brackets 100.

Referring to FIG. 2*b* and FIG. 3, the bracket system 200 may include a lift bracket 205 for supporting a support beam 155 at at least one of a top step or a bottom step of the stairway, wherein one of the first support 152 and the second support 154 may be the support beam 155. The lift bracket 205 may include a lift riser support 215 for coupling with the riser 105. The lift riser support 215 may include a front surface for bearing against the riser 105.

The lift bracket may also include a beam support 220 coupled to the lift riser support 215. The beam support 220 may be fastenable to the support beam 155. In some embodiments, the beam support 220 may extend from the lift riser support 215 such that a top surface of the beam support 220 may be positioned to support the support beam 155.

The beam support 220 may extend away from the lift riser support 215 at any suitable angle. For example, in some embodiments, the angle between the beam support 220 and the lift riser support 215 may be about 65 degrees to 75 degrees. In certain embodiments, the angel between the beam support 220 and the lift riser support 215 may be about 70 degrees.

Each of the beam support 220 and the lift riser support 215 may be of any suitable shape and size. For example, in some embodiments, each of the lift riser support 215 and the beam support 220 may be plates. The plates may have any suitable width. In some embodiments, the beam support 220 may have a width about equal to the width of the support beam 155. For example the beam support 220 may be about 2.75" wide. The lift riser support 215 may, in some embodiments, be equal in width to the beam support 220. In certain embodiments, the width of the lift riser support 215 may be about the width of the riser 105, which may be, for example, about 1.5" to 1.75" wide.

The lift riser support 215 and the beam support 220 may be connected using any suitable coupling. For example, in embodiments where the beam support 220 and the lift riser support 215 are formed of steel, the beam support 220 may be welded to the riser support 215.

In some embodiments, a support web 230 may be coupled to the lift riser support 215 and the beam support 220 to strengthen the lift bracket 205. For metallic lift brackets 205, a metallic support web 230 may be used. In some embodiments, a steel plate may be welded to the beam support 220 and the lift bracket 205 as the support web 230.

The support web 230 may be of any suitable size and shape. For example, in some embodiments, the support web 230 may be a triangular plate with two equal sides of about 2.5" long.

In some embodiments, the lift bracket 205 may include a riser tab 240 extending from the lift riser support 215 for coupling with a top of the riser 105. The riser tab 240 may be for positioning the lift bracket 205 such that an underside of the support beam 155 is positioned a distance above a top of the riser 105 that is sufficient to provide finishing clearance underneath the support beam 155. The distance may be any suitable size. In certain embodiments, the distance f may be about 1.5".

The riser tab 240 may be of any suitable size and shape. The riser tab 240 may be, for example, about an inch long and have a width about equal to the lift riser support 215. The riser tab 240 may extend out at about 90 degrees to the plane of the lift riser support 215 and, in some embodiments, may be a steel plate welded to the lift riser support 215. Any suitable coupling may be used to couple the riser tab 240 to the lift riser support 215.

The lift riser support 215 and the riser tab 240 may be fastenable to the riser 105 and the beam support 220 may be fastenable to the support beam 155. Each of the riser tab 240, the lift riser support 215 and the beam support 220 may include holes for nailing or screwing the lift bracket to the riser 105 and the support beam 155.

In use, in accordance with some embodiments, to install the brackets 100, a user may first locate stair nosings on wall forms or on a pre-existing concrete wall. The user may draw stairs out on the wall on both sides of the stairway. Allowances may be made for riser form 105 thickness as well as kickbacks on stair nosings. The brackets 100 may then be set to the stair layout and fastened to the walls through nail holes in the brackets 100 using, for example, 3-¼" duplex nails.

Once all brackets 100 have been installed down both sides of the stair run, the users may layout riser forms 105 face down on the stair throat soffit. The users may then install a bottom stair riser 105 by fastening it to brackets on both ends of the bottom riser 105. 2"×4" wood braces may be used to set bottom stair risers straight using a string line and the wood braces may be pinned to the ground at the bottom of the staircase.

Next, a riser 105 for the top step of the staircase may be attached to brackets on either side of the staircase across the width of the staircase. Both the top and bottom step risers 105 may then be marked to show where a support beam 155 may be positioned. Lift brackets 205 may than be attached to the risers 105 at the top and bottom steps. Wood screws may be used to fasten the lift brackets 205.

A support beam 155, such as a double 2"×6" support beam, may be placed on the lift brackets 205 and slid down towards the bottom of the staircase until the support beam 155 bumps into the ground. The lower lift bracket 205 may then be screwed to the support beam 155. Then, ensuring that the riser 105 at the top step is straight, the top lift bracket 205 may be screwed to the support beam 155. Brackets 100 may be then attached at the top and bottom steps to one or both sides of the support beam 155 and to the top and bottom step risers 105.

In some cases, as shown in FIG. 2*a* and FIG. 2*b*, a wood kicker block 190 may be pinned to the ground behind the support beam 155 at the bottom of the staircase to brace the support beam 155. Additionally, across support beam 191 may be placed at one or more positions along the staircase stretching across the width of the staircase and perpendicular to support beam 155. For example, in some embodiments, a pair of 2×6" boards may be placed on edge, one at the top and one at the bottom of the staircase, on top of support beam 155, stretching across the width of the staircase perpendicular to support beam 155. The pair of 2"×6" cross support beams 191 may be pinned to supports, such as sidewalls, at each end of the staircase.

The 2"×6" cross support beams 191 may reduce the possibility of uplift of support beam 155. Additional uplift supports 192 may be provided by nailing, for example, 2"×4" boards above the cross support beams 191 against a support such as a side wall. The additional uplift supports 192 may provide additional force to keep the support beam 155 from lifting up as concrete is poured.

For the remaining risers 105, other than the top and bottom risers 105, starting at the top of the staircase, a bracket 100 may be attached to the nosing of the riser 105 where the riser 105 meets the support beam 155. The riser may be straightened and the bracket 100 may nailed to the support beam 155. The riser 105 may also be fastened to the brackets 100 on either wall. In some embodiments, the brackets 100 installed on the support beam 155 may be staggered on either side of the support beam 155, with a bracket 100 being on the same side of the support bean 100 for every other riser 105. Once all of the risers 105 have been braced with brackets 100, concrete may be poured to form the stairs.

In some embodiments, as an optional support, a nosing brace 195 may be positioned to stretch from a top of the stair case to a bottom of the staircase along a central portion of the staircase and about perpendicular to the risers 105. The nosing brace 195 may be a board such as, for example, a 2"×4". Duplex nails may be used to nail the nosing brace 195 to the nosing of each riser 105.

Referring to FIG. 4, an embodiment of a method 400 for positioning and bracing risers of step forms for a staircase is provided. At box 410, a front surface of a riser support of a bracket may be attached to a riser to brace the riser.

At box 420, the riser may be positioned by fastening the riser support as well as a top support arm and a back support arm of the bracket to an external support using fastening plates coupled to at least two of the top support arm, the back support arm, and the riser support.

At box 430, the riser may be braced by providing supports to the riser support at a top and a bottom end of the riser support. The support may be provided by the back support arm and the top support arm. A first end of the top support arm may be coupled to a first end of the back support and a second end of the top support may be coupled to the top end of the riser support and a second end of the back support may be coupled to the bottom end of the riser support such that the riser support, the back support and the top support form a triangle.

The components described in the method above may be similar to the components of the bracket 100 discussed earlier.

The terminology used herein is for the purpose of describing particular embodiments only and is not intended to be limiting. Accordingly, as used herein, the singular forms "a", "an" and "the" are intended to include the plural forms as well, unless the context clearly indicates otherwise. It will be further understood that the terms "comprises" and "comprising," when used in this specification, specify the presence of one or more stated features, integers, steps, operations, elements, and components, but do not preclude the presence or addition of one or more other features, integers, steps, operations, elements, components, and groups.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A bracket for holding a riser of a step form in position when pouring concrete to make a stairway, the bracket comprising:

(a) a riser support for coupling with the riser, the riser support comprising a surface for bearing against the riser;

(b) a top support, a first end of the top support coupled to the riser support, for providing support to the riser support;

(c) a back support for providing lateral support to the riser support, the back support coupled to both the riser support and the top support such that an area enclosed by the riser support, the back support and the top support is a triangle;

(d) wherein at least two of the riser support, the back support and the top support comprise fastening plates for coupling with a support extending from a top of the stairway to a bottom of the stairway, each of the fastening plates being parallel to a plane defined by the triangle and positioned to contact the support.

2. The bracket of claim 1 further comprising a positioning tab coupled to the riser support, the positioning tab extending from the surface of the riser support and positioned to bear against a top edge of the form and thereby, position the bracket relative to the riser of the form.

3. The bracket of claim 2 wherein the positioning tab is positioned to position the bracket such that the riser support does not extend closer than about one inch of a tread immediately below the riser support.

4. The bracket of claim 1 wherein the fastening plate of the top support extends parallel to the plane defined by the triangle and does not extend into the triangle.

5. The bracket of claim 1 wherein the fastening plates of the riser support or the back support extend parallel to the plane defined by the triangle and extend into the triangle.

6. The bracket of claim 1 wherein the back support extends from the riser support at an angle sufficiently small such that there is sufficient clearance between the back support and a tread of a step immediately below the back support to use surfacing tools on the tread.

7. The bracket of claim 1 wherein the back support extends from the riser support at an angle smaller than about sixty degrees.

8. A bracket system for constructing a stairway form, the bracket system comprising:

(a) at least one pair of brackets for holding a riser of the stairway form in position, with each bracket comprising:

(i) a riser support for coupling with the riser, the riser support comprising a surface for bearing against the riser;

(ii) a top support, a first end of the top support coupled to the riser support, for providing support to the riser support;

(iii) a back support for providing lateral support to the riser support, the back support coupled to both the riser support and the top support such that an area enclosed by the riser support, the back support and the top support is a triangle;

(iv) wherein at least two of the riser support, the back support and the top support comprise fastening plates for coupling with one of a first support and a second support, each of the first support and the second support extending from a top of the stairway to a bottom of the stairway, each of the fastening plates being parallel to a plane defined by the triangle and wherein the fastening plates on a first bracket of the pair of brackets are positioned to contact the first support, with the first support located on a first side of the pair of brackets, and wherein the fastening plates on a second bracket of the pair of brackets are positioned to contact the second support, with the second support located on a second side of the pair of brackets.

9. The bracket system of claim 8 further comprising a lift bracket for supporting a support beam at at least one of a top step or a bottom step of the stairway, wherein one of the first support and the second support is the support beam, the lift bracket comprising:

(a) a lift riser support for coupling with the riser, the lift riser support comprising a surface for bearing against the riser;

(b) a beam support coupled to the riser support fastenable to the support beam, the beam support extending from the lift riser support such that a top surface of the beam support is positioned to support the support beam;

(c) a positioning tab extending from the lift riser support for coupling with a top of the riser for positioning the lift bracket such that an underside of the support beam is positioned a distance above a top of the riser that is sufficient to provide finishing clearance.

10. The system of claim 9 wherein the distance is about 1.5 inches.

11. A method using the system of claim 9 for positioning and bracing risers of step forms for the staircase, the method comprising;

(a) attaching a front surface of the riser support of the bracket to the riser to brace the riser;

(b) positioning the riser by fastening the riser support as well as the top support and the back support of the bracket to an external support using the fastening plates coupled to at least two of the top support, the back support, and the riser support;

(c) bracing the riser by providing supports to the riser support at a top and a bottom end of the riser support, the supports being provided by the back support and the top support, a first end of the top support being coupled to a first end of the back support and a second end of the top support being coupled to the top end of the riser support and a second end of the back support being coupled to the bottom end of the riser support, the riser support, the back support and the top support forming a triangle.

* * * * *